US011719402B2

(12) United States Patent
Zhong et al.

(10) Patent No.: US 11,719,402 B2
(45) Date of Patent: Aug. 8, 2023

(54) OPTICAL ASSEMBLY, VEHICLE LAMP, AND MOTOR VEHICLE

(71) Applicant: VALEO VISION, Bobigny (FR)

(72) Inventors: Xing Zhong, Wuhan (CN); Anna Gu, Wuhan (CN); Hongchao Dong, Wuhan (CN); Qiang Hu, Wuhan (CN); Yagui Gao, Wuhan (CN)

(73) Assignee: VALEO VISION, Bobigny (FR)

( * ) Notice: Subject to any disclaimer, the term of this patent is extended or adjusted under 35 U.S.C. 154(b) by 119 days.

(21) Appl. No.: 17/442,420

(22) PCT Filed: Apr. 1, 2020

(86) PCT No.: PCT/CN2020/082668

§ 371 (c)(1),
(2) Date: Sep. 23, 2021

(87) PCT Pub. No.: WO2020/200216

PCT Pub. Date: Oct. 8, 2020

(65) Prior Publication Data

US 2022/0186901 A1 Jun. 16, 2022

(30) Foreign Application Priority Data

Apr. 1, 2019 (CN) ..... 201920433067.2

(51) Int. Cl.
*F21S 41/24* (2018.01)

(52) U.S. Cl.
CPC ..... *F21S 41/24* (2018.01)

(58) Field of Classification Search
CPC ..... F21S 43/237; F21S 41/24; F21S 43/241; F21S 43/245; F21S 43/251
See application file for complete search history.

(56) References Cited

U.S. PATENT DOCUMENTS 6,880,945 B2 * 4/2005 Knaack ..... F21S 41/24 362/615
9,039,260 B2 5/2015 Faffelberger
(Continued)

FOREIGN PATENT DOCUMENTS

CN 103090314 A 5/2013
CN 103398339 A 11/2013
(Continued)

OTHER PUBLICATIONS

International Search Report dated Jul. 1, 2020 in PCT/CN2020/082668 filed Apr. 1, 2020, 2 pages.
(Continued)

*Primary Examiner* — Matthew J. Peerce
(74) *Attorney, Agent, or Firm* — Oblon, McClelland, Maier & Neustadt, L.L.P.

(57) ABSTRACT

An optical assembly, a vehicle lamp and a motor vehicle are disclosed. The optical assembly includes a light guide, the light guide at least having a first light guide section, a second light guide section and a bridging light guide section. The first light guide section and the second light guide section are connected together at one end to form an end region and bifurcating from the end region, the end region having an end face for the in-coupling of light. The bridging light guide section is arranged between the first light guide section and the second light guide section. The bridging light guide section is spaced apart from a bifurcation position of the first light guide section and the second light guide section, and the bridging light guide section has a light in-coupling face facing the bifurcation position, and a light out-coupling face.

19 Claims, 2 Drawing Sheets

(56) References Cited

U.S. PATENT DOCUMENTS

| | | | | |
|---|---|---|---|---|
| 10,017,101 | B2 | 7/2018 | Herbin et al. | |
| 10,371,341 | B2 * | 8/2019 | Hanami | F21S 43/241 |
| 10,928,028 | B2 * | 2/2021 | Cho | F21S 43/249 |
| 2003/0026106 | A1 | 2/2003 | Knaack et al. | |
| 2011/0110111 | A1 * | 5/2011 | Rho | F21S 43/249<br>362/509 |
| 2016/0347234 | A1 * | 12/2016 | Herbin | B60Q 1/26 |

FOREIGN PATENT DOCUMENTS

| | | | |
|---|---|---|---|
| CN | 106195849 | A | 12/2016 |
| CN | 107036026 | A | 8/2017 |
| DE | 101 37 605 | A1 | 2/2003 |
| EP | 3 205 926 | A1 | 8/2017 |
| FR | 3 036 774 | A1 | 12/2016 |
| FR | 3 051 885 | A1 | 12/2017 |
| FR | 3 051 886 | A1 | 12/2017 |
| JP | 2014-7014 | A | 1/2014 |

OTHER PUBLICATIONS

Extended European Search Report dated Oct. 31, 2022 in European Patent Application No. 20784756.7, 8 pages.

Office Action dated Nov. 25, 2022, in corresponding Japanese Patent Application No. 2021-558694 (with Partial English Translation), 9 pages.

* cited by examiner

OPTICAL ASSEMBLY, VEHICLE LAMP, AND MOTOR VEHICLE

TECHNICAL FIELD

The present invention relates to an optical assembly, a vehicle lamp and a motor vehicle.

BACKGROUND ART

Light guide assemblies are being used more and more in current motor vehicle lamps. Light from a light source is coupled into the light guide assembly through an end face of the light guide assembly. The light guide assembly is columnar, and generally has a round cross section, but can also have other cross-sectional shapes, e.g. elliptical. At least a partial section of the light guide assembly in the length direction has a light decoupling structure, for example, optical teeth, to disrupt the conditions for total reflection of light in the light guide assembly, thus the light emerges at the other side of the light guide assembly, opposite the light decoupling structure. Here, the overall course of the light guide assembly is generally designed according to the overall shape of the motor vehicle. In some cases, a desired shape requires the light guide assembly to be split into at least two branches. In such a situation, the problem of a non-uniform illumination effect will generally arise at the branching position, giving rise to unacceptable and uncontrollable light spots, especially dark regions.

SUMMARY OF THE INVENTION

Thus, an object of the present invention is to provide an optical assembly that can achieve a uniform illumination effect and can also be manufactured cost-effectively.

According to the present invention, this object is achieved as follows by means of the proposed optical assembly: the optical assembly comprises a light guide, the light guide at least having a first light guide section, a second light guide section and a bridging light guide section, the first light guide section and the second light guide section being connected together at one end to form an end region and separating at a bifurcation position of the end region, the end region having an end face for the in-coupling of light from a light source, and the bridging light guide section being arranged between the first light guide section and the second light guide section, wherein the bridging light guide section is spaced apart from the bifurcation position of the first light guide section and the second light guide section, for example by at least 10 mm, and the bridging light guide section has a light in-coupling face facing the bifurcation position and a light out-coupling face arranged opposite the light in-coupling face.

In the optical assembly, light from the light source is coupled into the end region at the end face thereof. By providing the bridging light guide section, the light coupled into the end region can propagate towards the bridging light guide section, and can continue to propagate along the light guide sections of the optical assembly. In this way, a uniform light output effect is achieved along the entire light output length.

The "bifurcation position" should be understood as the position where the light guide sections separate from one another out of the region where they are connected together. Here, connection includes direction connection and indirect connection. Specifically, direct connection means that the light guide sections abut each other; indirect connection means that the light guide sections are connected together via an intermediate element. For this reason, the bifurcation position can take the form of a line or a surface.

In a plane transverse to the longitudinal extension of the bridging light guide section, the bridging light guide section has a trapezoidal cross section, wherein the width of the light in-coupling face is greater than the width of the light out-coupling face. Here, the width of the light out-coupling face can substantially correspond to the widths of light decoupling structures of the first light guide section and second light guide section or the width of the light exit faces arranged opposite thereto in cross sections transverse to their longitudinal extensions. The angle formed by at least one of the side edges of the trapezoidal cross section and a main light exit direction of the optical assembly is in the range of 0-22.7°. For this reason, in this solution, the intensity in all directions of light emitted from the light out-coupling face of the bridging light guide section is substantially the same as the intensity in all directions of light emitted from the light exit faces of the light guide sections, thereby achieving a light output effect that is uniform in all directions.

The optical assembly may further be configured such that corresponding ends of the first light guide section and the second light guide section are connected together by means of a middle section, such that at least a portion of light can enter the bridging light guide section by transmission of the middle section, wherein the middle section forms a part of the end region. This can further facilitate the homogenization of light.

In addition, the optical assembly may be configured such that at least one of the light in-coupling face and light out-coupling face of the bridging light guide section is provided with a structure for homogenizing light. As an example, the structure for homogenizing light takes the form of an undulating surface, a micro-pillow structure array surface or a roughened surface, or takes another suitable form. The structure for homogenizing light as described above for example enables light to undergo diffusive refraction at a sunken part and convergent refraction at a protruding part, while the direction of propagation is not changed at the position in a surface perpendicular to the propagation direction of light, such that light is uniformly modulated.

The first light guide section and second light guide section of the light guide are each provided with a light decoupling structure, one end of the light decoupling structure extending beyond the light in-coupling face of the bridging light guide section, such that at least a portion of light can be deflected into the light in-coupling face of the bridging light guide section via the light decoupling structure. For example, the light decoupling structure can be optical teeth, i.e. prisms, which disrupt the total reflection of light in the light guide section, thus enabling light to emerge from a face opposite the light decoupling structure. In this design solution, this further homogenizes the light emitted via the bridging light guide section.

As an example, the light decoupling structure is formed of two rows of secondary light decoupling structures with different light decoupling capabilities. When the light decoupling structure is a prism structure, the secondary light decoupling structures may be prisms of different sizes or with different geometric structures, in order to achieve different light exit directions.

The optical assembly is a one-piece component formed of a transparent material. For example, it is injection moulded from polycarbonate, poly(methyl methacrylate) or another suitable material.

The first light guide section and the second light guide section may enclose a closed loop.

The optical assembly may have two light guide sections, which are bifurcated relative to each other.

The bridging light guide section and the bifurcation position are spaced apart by at least 10 mm, to facilitate manufacture.

Another aspect of the present invention relates to a vehicle lamp, having the optical assembly as described above.

Another aspect of the present invention relates to a vehicle, having the vehicle lamp as described above.

BRIEF DESCRIPTION OF THE DRAWINGS

The present invention is expounded further below with the aid of the accompanying drawings. In the drawings.

DETAILED DESCRIPTION OF THE INVENTION

Embodiments of the present invention are explained demonstratively below. As those skilled in the art should realize, the embodiments explained may be amended in various ways without departing from the concept of the present invention. Thus, the accompanying drawings and the description are in essence demonstrative and non-limiting. In the following text, identical drawing reference labels generally indicate functionally identical or similar elements.

Figure 1:
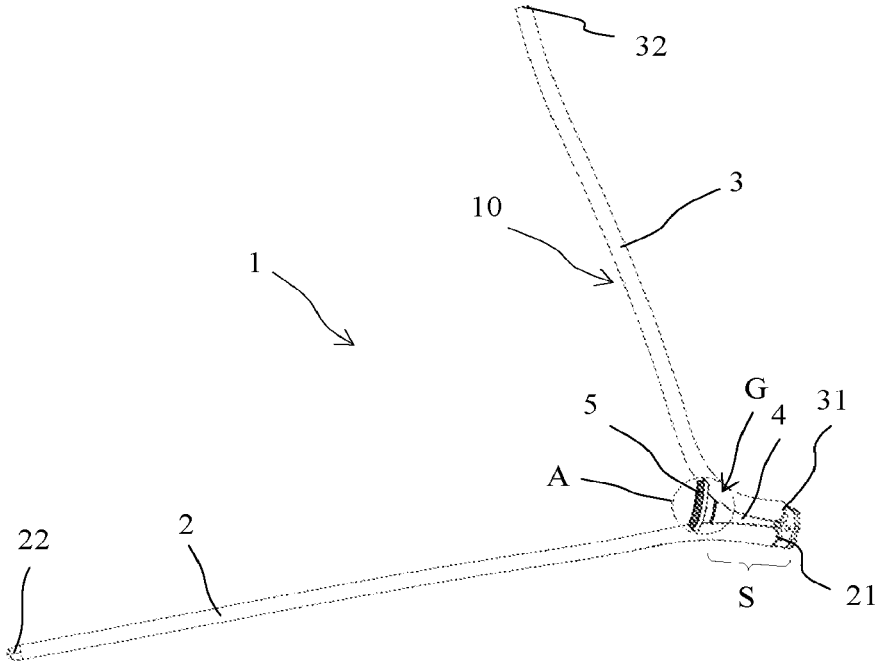
FIG. 1 shows schematically a three-dimensional drawing of an embodiment of the optical assembly according to the present invention.

FIG. 1 shows an exemplary drawing of an optical assembly 1 according to the present invention. Here, the optical assembly 1 includes two light guide sections 2, 3 and a bridging light guide section 5, wherein the bridging light guide section 5 is arranged between the two light guide sections 2, 3. In principle, any number of light guide sections and corresponding bridging light guide sections may be selected. The light guide sections are connected together at one end to form an end region S and separate at a bifurcation position G of the end region, and the bridging light guide section 5 is spaced apart from the bifurcation position G. The bridging light guide section 5 has a light in-coupling face 51 and a light out-coupling face 52; the light in-coupling face 51 faces the bifurcation position, and the light out-coupling face 52 is arranged opposite the light in-coupling face 51.

In the example shown, the light guide sections 2, 3 take the form of two light guiding bodies, for example having a round or elliptical cross section and a diameter between 3 mm and 12 mm. They spread out towards two sides from the bifurcation position G, and correspondingly each have an end face 21, 31 for the in-coupling of light from a light source and another end 22, 32 arranged opposite the end face, thereby exhibiting a linear illumination effect when light is propagated in the optical assembly. As can be seen, a positioning pin 11 for the optical assembly is provided at the end faces 21, 31.

In another example which is not shown, the light guide sections 2, 3 and bridging light guide section 5 of the optical assembly 1 enclose a closed loop. The shape of the closed loop can be specifically selected according to the required illumination shape.

The light guide sections 2, 3 of the optical assembly 1 can abut each other directly. Here, the light guide sections 2, 3 and bridging light guide section 5 enclose a substantially triangular gap.

Figure 2:
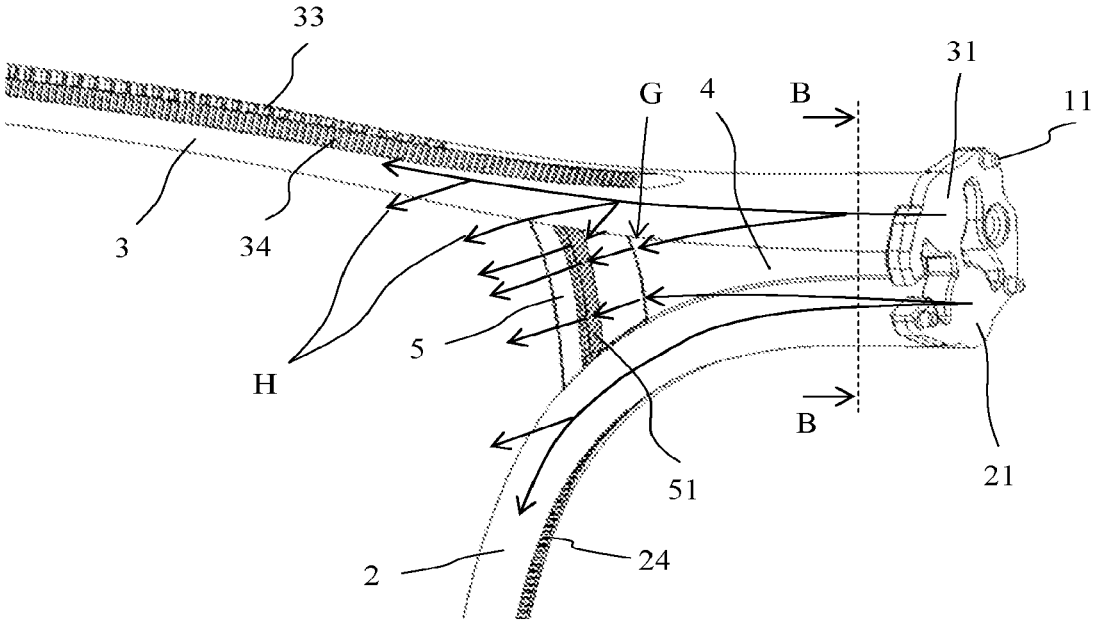
FIG. 2 shows schematically a detailed drawing of the bifurcation position of the optical assembly according to the present invention.
Figure 3:
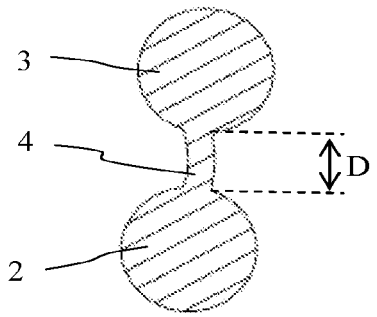
FIG. 3 shows schematically a sectional view along section line B-B in FIG. 2.

Alternatively, as shown in FIG. 2, the light guide sections 2, 3 can also be connected together via a middle section 4. The middle section 4 between the light guide sections 2, 3 has a width D in a cross section transverse to a main light exit direction H, see FIG. 3. The middle section may be made of the same material as the light guide sections; this makes it easier for light to enter the middle section from the light guide sections. Here, a face 41 of the middle section 4 that is located foremost in the main light exit direction, the light guide sections 2, 3 and the bridging light guide section 5 together enclose a substantially trapezoidal shape.

Figure 4:
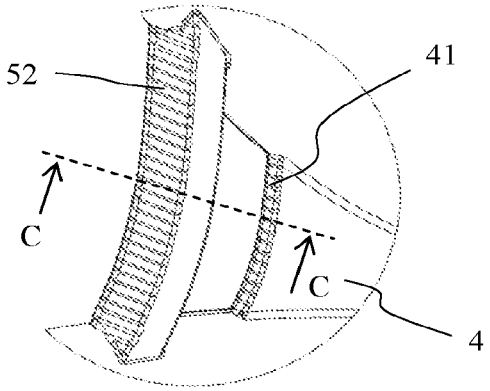
FIG. 4 shows schematically a partial enlarged drawing of region A in FIG. 1.

The face 41 of the middle section 4 that faces the bridging light guide section 5 may have an undulating structure, see FIG. 4. The undulating profile can homogenize light emerging from the face 41 at least to a certain extent.

In FIG. 2, the middle section 4 is shown as beginning at the end faces of the light guide sections 2, 3, but it can also begin at a position that is separated from the end faces of the light guide sections 2, 3 by a predetermined distance.

Like the face 41 of the middle section 4 mentioned above, the light in-coupling face 51 and light out-coupling face 52 of the bridging light guide section 5 may also have an undulating structure, so as to achieve the effect of homogenizing light. It is likewise feasible for the three faces mentioned to have another structure for homogenizing light, e.g. a micro-pillow structure array structure, a roughened structure or another suitable structure. The structure for homogenizing light can be used on each face as needed.

The light guide sections 2, 3 each may have a light decoupling structure extending in the longitudinal direction thereof at a circumferentially outer side, in order to disrupt the conditions for total reflection, in the light guide section 2, 3, of light entering the light guide section 2, 3, such that light can emerge from the other side of the light guide section 2, 3, opposite the light decoupling structure. The light decoupling structure may take the form of optical teeth, i.e. prisms, and these prisms may have a separation of about 1.5 mm in the direction of light transmission. One end of the light decoupling structure of the light guide section 2, 3 extends beyond the bridging light guide section 5 in the direction of the end face of the optical assembly 1, and if necessary extends beyond the bifurcation position G, such that the light can be deflected from the light guide section 2, 3 into the light in-coupling face 51 of the bridging light guide section 5.

The light decoupling structure of the light guide section 2, 3 may be formed of multiple secondary light decoupling structures. As shown in FIG. 2, the light decoupling structure of the light guide section 3 is formed of superposed secondary light decoupling structures 33, 34, which can have different geometric structures, e.g. having optical teeth of different sizes, in order to achieve a uniform light output effect in all directions. A secondary light decoupling structure 24 of the light guide section 2 may be configured similarly to the light guide section 3. Of course, the respective light decoupling structures of the light guide sections 2, 3 may also be configured differently.

Figure 5:
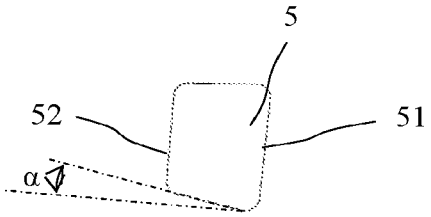
FIG. 5 shows schematically a sectional view along section line C-C in FIG. 4.

FIG. 5 shows a sectional view of the bridging light guide section 5 along section line C-C in FIG. 4. It can be seen here that the bridging light guide section 5 has a substantially trapezoidal cross section. The angle α formed by at least one of the side edges of the trapezoidal cross section and the main light exit direction is in the range of 0-22.7°, the length of the long bottom edge in the cross section corresponds to the diameter of the light guide section, and the length of the short bottom edge corresponds to the width of a light exit face or the light decoupling structure arranged on the light guide section, thereby achieving a uniform and optimal light output effect. In particular, a light output width at the bridging light guide section can be set by adjusting the size of the value of the angle α between the side edge and the main light exit direction.

The optical assembly described above can be integrally formed of an at least partially light-permeable material, e.g. injection moulded from polycarbonate, poly(methyl methacrylate), etc. The longitudinal extension of the optical assembly can be selected according to actual shaping requirements.

The present invention is not limited to the structure described above; various other variants could also be used. Although the present invention has already been described by means of a limited number of embodiments, those skilled in the art could, drawing benefit from this disclosure, design other embodiments which do not depart from the scope of protection of the present invention disclosed herein. Thus, the scope of protection of the present invention should be defined by the attached claims alone.

The invention claimed is:

1. An optical assembly, comprising a light guide, the light guide at least having a first light guide section, a second light guide section and a bridging light guide section, the first light guide section and the second light guide section being connected together at one end to form an end region and separating at a bifurcation position of the end region, the end region having an end face for the in-coupling of light from a light source, and the bridging light guide section being arranged between the first light guide section and the second light guide section, characterized in that the bridging light guide section is spaced apart from the bifurcation position of the first light guide section and the second light guide section, and the bridging light guide section has a light in-coupling face facing the bifurcation position and a light out-coupling face arranged opposite the light in-coupling face wherein in a plane transverse to the longitudinal extension of the bridging light guide, the bridging light guide section has a trapezoidal cross section, wherein the width of the light in-coupling face is greater than the width of the light out-coupling face.

2. The optical assembly according to claim 1, wherein the width of the light out-coupling face corresponds to the widths of light exit faces of the first light guide section and second light guide section in cross sections transverse to their longitudinal extensions.

3. The optical assembly according to claim 2, wherein the first light guide section and second light guide section of the light guide are each provided with a light decoupling structure, one end of the light decoupling structure extending beyond the light in-coupling face of the bridging light guide section, such that at least a portion of light is deflected into the light in-coupling face via the light decoupling structure.

4. The optical assembly according to claim 2, wherein the optical assembly is a one-piece component formed of a transparent material.

5. The optical assembly according to claim 2, wherein the bridging light guide section and the bifurcation position are spaced apart by at least 10 mm.

6. The optical assembly according to claim 1, wherein corresponding ends of the first light guide section and the second light guide section are connected together by means of a middle section, such that at least a portion of light enters the bridging light guide section by transmission of the middle section, wherein the middle section forms a part of the end region.

7. The optical assembly according to claim 6, wherein at least one of the light in-coupling face and light out-coupling face of the bridging light guide section is provided with a structure for homogenizing light.

8. The optical assembly according to claim 7, wherein the structure for homogenizing light takes the form of an undulating surface, a micro-pillow structure array surface or a roughened surface.

9. The optical assembly according to claim 1, wherein the angle formed by at least one of the side edges of the trapezoidal cross section and a main light exit direction of the optical assembly is in a range of 0-22.7°.

10. The optical assembly according to claim 1, wherein the first light guide section and second light guide section of the light guide are each provided with a light decoupling structure, one end of the light decoupling structure extending beyond the light in-coupling face of the bridging light guide section, such that at least a portion of light is deflected into the light in-coupling face via the light decoupling structure.

11. The optical assembly according to claim 1, wherein the optical assembly is a one-piece component formed of a transparent material.

12. The optical assembly according to claim 1, wherein the bridging light guide section and the bifurcation position are spaced apart by at least 10 mm.

13. The optical assembly according to claim 1, wherein the first light guide section and second light guide section of the light guide are each provided with a light decoupling structure, one end of the light decoupling structure extending beyond the light in-coupling face of the bridging light guide section, such that at least a portion of light is deflected into the light in-coupling face via the light decoupling structure.

14. The optical assembly according to claim 13, wherein the light decoupling structure is formed of two rows of secondary light decoupling structures with different light decoupling capabilities.

15. The optical assembly according to claim 1, wherein the optical assembly is a one-piece component formed of a transparent material.

16. The optical assembly according to claim 15, wherein the first light guide section and the second light guide section form a closed loop.

17. The optical assembly according to claim 1, wherein the bridging light guide section and the bifurcation position are spaced apart by at least 10 mm.

18. A vehicle lamp, having the optical assembly according to claim 1.

19. A vehicle, having the vehicle lamp according to claim 18.

* * * * *